US009993046B2

(12) United States Patent
Bock

(10) Patent No.: US 9,993,046 B2
(45) Date of Patent: Jun. 12, 2018

(54) SHOE, IN PARTICULAR A SPORTS SHOE

(71) Applicant: PUMA SE, Herzogenaurach (DE)

(72) Inventor: Markus Bock, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 0 days. days.

(21) Appl. No.: 15/556,218

(22) PCT Filed: Oct. 7, 2015

(86) PCT No.: PCT/EP2015/001962
§ 371 (c)(1),
(2) Date: Sep. 6, 2017

(87) PCT Pub. No.: WO2017/059875
PCT Pub. Date: Apr. 13, 2017

(65) Prior Publication Data
US 2018/0035760 A1 Feb. 8, 2018

(51) Int. Cl.

| | |
|---|---|
| ***A43C 11/20*** | (2006.01) |
| ***A43C 11/16*** | (2006.01) |
| ***A43B 23/02*** | (2006.01) |
| ***A43B 5/00*** | (2006.01) |
| ***A43B 3/00*** | (2006.01) |

(52) U.S. Cl.
CPC ..... *A43C 11/165* (2013.01); *A43B 3/0005* (2013.01); *A43B 5/00* (2013.01); *A43B 23/0245* (2013.01); *A43C 11/20* (2013.01)

(58) Field of Classification Search
CPC ..... A43C 11/16; A43C 11/165; A43C 11/20
USPC ..... 36/50.1, 50.5
See application file for complete search history.

(56) References Cited

U.S. PATENT DOCUMENTS

| | | | | |
|---|---|---|---|---|
| 4,748,726 | A | 6/1988 | Schoch | |
| 5,042,177 | A * | 8/1991 | Schoch | A43C 11/16 24/68 SK |
| 5,319,868 | A * | 6/1994 | Hallenbeck | A43C 11/00 36/50.1 |
| 5,325,613 | A | 7/1994 | Sussmann | |
| 6,052,921 | A * | 4/2000 | Oreck | A43C 1/00 36/50.1 |
| 7,159,340 | B2 * | 1/2007 | Borsoi | A43B 5/0405 36/10 |

(Continued)

FOREIGN PATENT DOCUMENTS

| | | |
|---|---|---|
| DE | 9200982 U1 | 5/1993 |
| DE | 29701491 U1 | 5/1998 |

(Continued)

*Primary Examiner* — Marie Bays
(74) *Attorney, Agent, or Firm* — Lucas & Mercanti, LLP

(57) ABSTRACT

A shoe, in particular a sports shoe, with a shoe upper and a rotary fastener for lacing the shoe on the foot of the wearer by at least one tensioning element, wherein the rotary fastener is arranged on the instep of the shoe and wherein the rotary fastener has a rotatably arranged tensioning roller. In order to improve the fit of the shoe to the foot of the wearer when such central fastener is used, a first tensioning element is arranged, which runs on the lateral side of the shoe upper, and a second tensioning element is arranged, which runs on the medial side of the shoe upper, wherein both tensioning element are fixed by the two ends thereof to the tensioning roller and each form a closed curve on the lateral side or on the medial side of the shoe upper.

14 Claims, 2 Drawing Sheets

(56) References Cited

U.S. PATENT DOCUMENTS

| | | | | |
|---|---|---|---|---|
| 8,713,820 | B2 * | 5/2014 | Kerns | A43B 3/0052 36/50.1 |
| 9,072,341 | B2 | 7/2015 | Jungkind | |
| 2004/0074110 | A1 * | 4/2004 | Borsoi | A43B 5/0405 36/50.5 |
| 2005/0022427 | A1 | 2/2005 | Kerns et al. | |
| 2005/0081403 | A1 * | 4/2005 | Mathieu | A43C 1/00 36/50.1 |
| 2007/0011913 | A1 * | 1/2007 | Holzer | A43B 5/0411 36/50.1 |
| 2007/0068040 | A1 * | 3/2007 | Farys | A43C 1/04 36/50.1 |
| 2012/0240428 | A1 * | 9/2012 | Knoll | A43B 5/0427 36/50.1 |
| 2015/0026936 | A1 * | 1/2015 | Kerns | A43B 3/0052 24/712.1 |
| 2015/0059208 | A1 * | 3/2015 | Kerns | A43B 3/0052 36/83 |

FOREIGN PATENT DOCUMENTS

| | | | |
|---|---|---|---|
| DE | 29817003 | U1 | 3/1999 |
| EP | 0255869 | A2 | 2/1988 |
| WO | 2014082652 | A1 | 6/2014 |

* cited by examiner

SHOE, IN PARTICULAR A SPORTS SHOE

The present application is a 371 of International application PCT/EP2015/001962, filed Oct. 7, 2015, the priority of this application is hereby claimed and this application is incorporated herein by reference.

BACKGROUND OF THE INVENTION

The invention relates to a shoe, in particular to a sports shoe, with a shoe upper and a rotary fastener for lacing the shoe on the foot of the wearer by means of at least one tensioning element, wherein the rotary fastener is arranged on the instep of the shoe and wherein the rotary fastener has a rotatably arranged tensioning roller, wherein a first tensioning element is arranged, which runs on the lateral side of the shoe upper, wherein a second tensioning element is arranged, which runs on the medial side of the shoe upper, and wherein both tensioning elements are fixed by the two ends thereof to the tensioning roller and each form a closed curve on the lateral side or on the medial side of the shoe upper.

Shoes with a rotary fastener are known for example from DE 297 01 491 U1. By means of such a rotary fastener it is possible at the tensioning of the tensioning element (lace thread or wire) by rotating of the rotary knob with low torque to create a sufficient high tensioning force at tying of the shoe. Furthermore, also a simple releasing of the tensioning element is possible when the shoe has to be taken off. For an easy operation of the rotary fastener it is preferably arranged on the instep of the shoe.

A shoe of the kind mentioned above is known from EP 0 255 869 A1. Other solutions are shown in DE 298 17 003 U1, in US 2005/022427 A1 and in DE 92 00 982 U1.

However, it was found that at pre-known closing systems still restrictions exist, that namely the tension in the tensioning element is not always distributed equally along the shoe upper at the tying and thus an inhomogeneity with respect to the distribution of the tensioning force is created.

SUMMARY OF THE INVENTION

It is an object of the invention to design a shoe of the above mentioned kind, especially a sports shoe, so that at easy operation of the rotary fastener, thus of a central fastener, it is made sure that the fit of the shoe at the foot of the wearer is optimized. Accordingly, the tying of the shoe by means of the rotary fastener should occur in such a manner that a distribution of the tension of the tensioning elements occurs as equal as possible. So, the fit of the shoe at the foot of the wearer should be improved.

The solution of this object by the invention is characterized in that each tensioning element runs from the tensioning roller to a first deflection element, which deflects the tensioning element in the bottom region of the shoe upper as well as at a location which is arranged in a region between 30% and 42% of the longitudinal extension, measured from the tip of the shoe.

The two closed curves of the two tensioning elements on the lateral side and on the medial side of the shoe upper are thereby preferably designed substantially symmetrically to a centre plane of the shoe, wherein the centre plane runs vertically and in longitudinal direction of the shoe.

The tensioning roller can be rotated by means of an electric motor drive. Alternatively, a manual operation is possible.

The axis of rotation of the tensioning roller is preferably perpendicular to the surface of the shoe in the region of the instep.

Specifically preferred a special guidance of the two tensioning element at the two sides of the shoe upper is provided to obtain an optimized distribution of the tensioning force and thus an optimized fit of the shoe at the foot of the wearer.

Furthermore, it can be provided that each tensioning element runs from the first deflection element to a second deflection element, which deflects the tensioning element in the bottom region of the shoe upper as well as at a location which is arranged in a region between 50% and 60% of the longitudinal extension, measured from the tip of the shoe.

Furthermore, each tensioning element can run from the second deflection element to a third deflection element, wherein the tensioning element is arranged in the upper region of the shoe upper adjacent to the rotary fastener.

Each tensioning element can furthermore run from the third deflection element to a fourth deflection element, which deflects the tensioning element in the bottom region of the shoe upper as well as at a location which is arranged in a region between 55% and 70% of the longitudinal extension, measured from the tip of the shoe.

Finally, it can be provided that each tensioning element runs from the fourth deflection element to a fifth deflection element, which deflects the tensioning element in the region between 33% and 66% of the total height of the shoe as well as at a location which is arranged in a region between 75% and 90% of the longitudinal extension, measured from the tip of the shoe, wherein the tensioning element runs from the fifth deflection element to the tensioning roller.

Thereby, the mentioned arrangement of the deflection elements in the bottom region of the shoe upper has to be understood in that manner that the deflection elements are fixed at the sole of the shoe and somewhat above the sole at the shoe upper respectively and so the location of deflection of the tensioning element lies in a height region which is below a level of 20% of the vertical extension of the shoe upper (when the shoe stands on the floor).

At least one of the deflection elements can be thereby designed as loop which is fixed, especially stitched on, at the shoe upper and/or at the sole of the shoe.

The loops can thereby consist of a band which is stitched on the shoe upper and/or on the sole of the shoe.

The mentioned fifth deflection element encompasses preferably the heel region of the shoe. Thereby, it is preferably provided that the fifth deflection element has a V-shaped design in a side view of the shoe, wherein in the side view of the shoe one of the legs of the V-shaped structure terminates in the upper heel region and the other leg of the V-shaped structure terminates in the bottom heel region.

The tensioning elements are preferably tensioning wires. They can comprise polyamide or consist of this material.

Thus, a core aspect of invention is that a rotary fastener tensions two separate tensioning wires—one for the lateral region and one for the medial region of the shoe.

The effect, which can be obtained thereby, is that at tying of the shoe the sole, especially in the region of the joint, is drawn upward ("sandwich-effect"); also the heel is drawn to the front region. Thereby the tying can be improved beneficially.

If a manually operated rotary fastener is used preferably a solution is employed as described in WO 2014/082652 A1; insofar, reference to this document is made explicitly.

However, also an electrically driven rotary fastener can be employed beneficially as described for example in DE 298 17 003 U1.

In the drawing an embodiment of the invention is depicted. It shows:

DETAILED DESCRIPTION OF THE INVENTION

Figure 1:
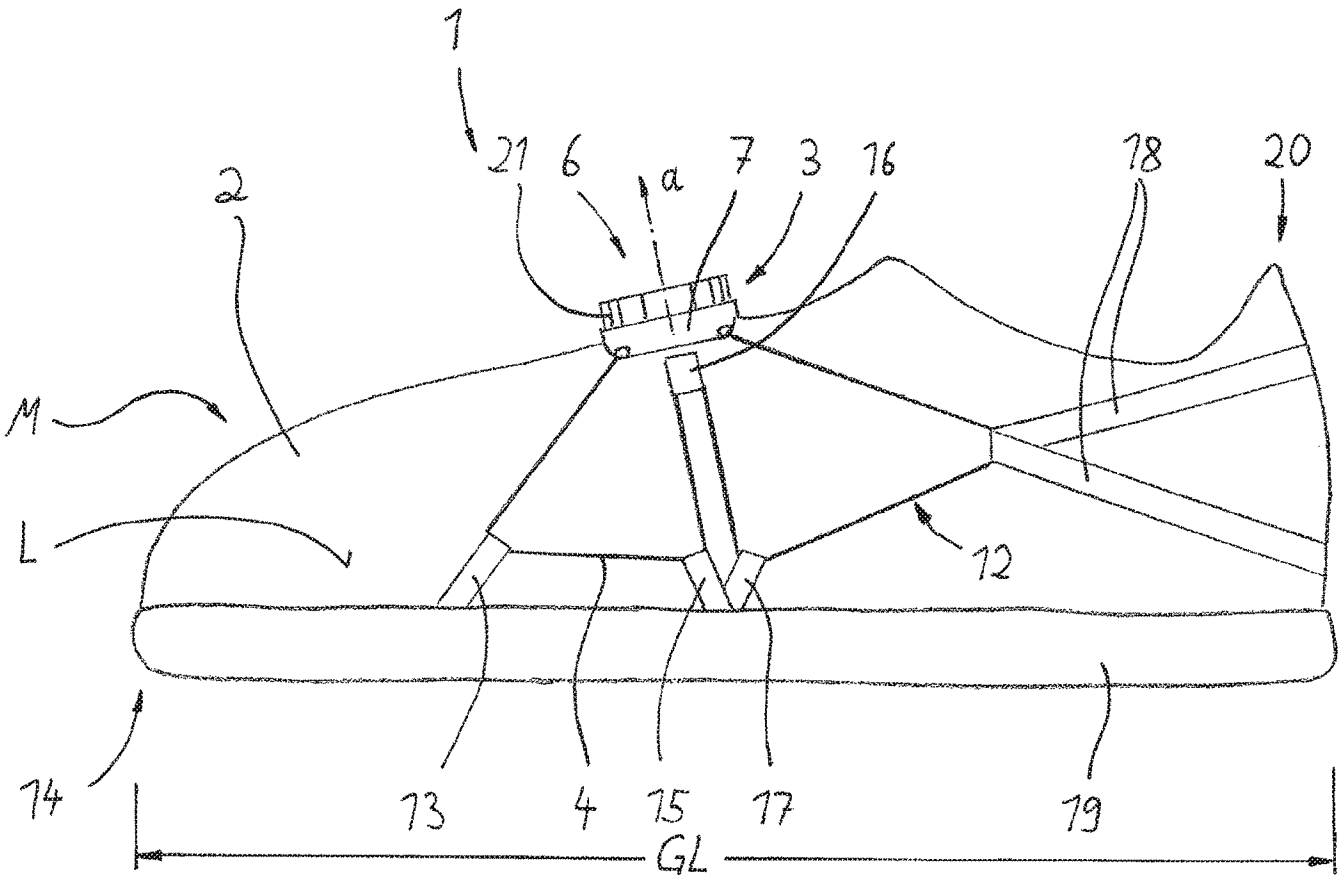
FIG. 1 schematically in the side view a sports shoe which can be laced with a rotary fastener and FIG. 2 schematically the tensioning roller of the rotary fastener with a schematic depiction of the fixation of the ends of the tensioning elements.

In FIG. 1 a shoe 1 is shown in the form of a sport shoe which comprises a shoe upper 2 and a sole 19. The lateral side L of the shoe 1 and of the shoe upper 2 respectively is shown in the depicted side view; the medial side M of the shoe 1 and of the shoe upper 2 respectively lies at the reverse side of the shoe 1 which cannot be seen (denoted by the reference numeral M).

The lacing of the shoe 1 occurs by means of a rotary fastener 3 (i.e. with a central closure), wherein two tensioning elements 4 and 5 are winded by rotating of a tensioning roller 7 (with a handwheel 21) on the tensioning roller and so the shoe upper 2 is tied at the foot of the wearer of the shoe 1.

The rotary fastener 3 is arranged on the instep 6 of the shoe 1. Accordingly, a convenient accessibility to the rotary fastener 3 is ensured for the user of the shoe.

Thereby, the axis of rotation 1 of the tensioning roller 7 is perpendicular on the region of the instep 6 of the shoe.

A first tensioning element 4 is provided for the lateral side L of the shoe upper 2 and a second tensioning element 5 for the medial side M of the shoe upper 2.

Figure 2:
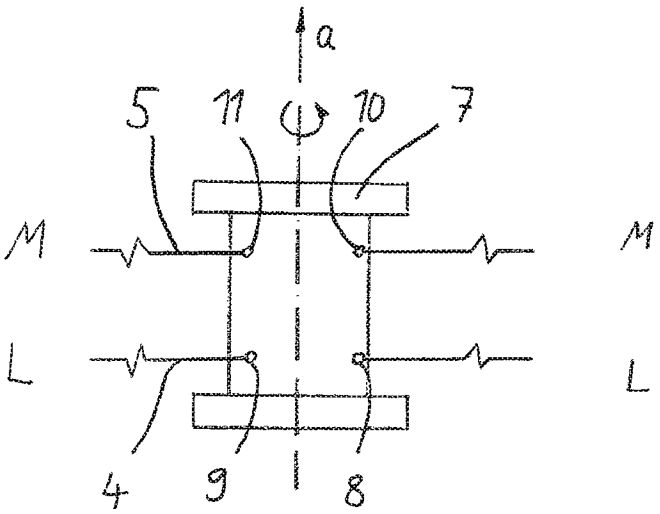

As can be seen from the schematic depiction according to FIG. 2 both ends 8 and 9 of the first tensioning element 4 as well as the two ends 10 and 11 of the second tensioning element 5 are fixed at the winding region of the tensioning roller 7 so that the section of the tensioning elements 4 and 5 respectively which is effectively available for tying can be shortened by rotating of the tensioning roller 7 and so the tying of the shoe takes place.

Thus, the closed curve 12 for the first tensioning element 5 for the lateral side L as shown in FIG. 1 contracts at the rotation of the tensioning roller 7 and causes that the shoe upper 2 is drawn to the foot of the wearer of the shoe 1.

As can be seen from FIG. 1 the closed curve 12, i.e. the guiding of the tensioning element 4 on the lateral side L of the shoe upper 2 (the same applies for the medial side M of the shoe upper 2), is specially designed. Therefore, five deflection elements are arranged, namely a first deflection element 13, a second deflection element 15, a third deflection element 16, a fourth deflection element 17 and a fifth deflection element 18.

The first deflection element 13 is thereby arranged in the front region of the shoe, namely at a longitudinal position of the shoe which correlates between 30% and 42% of the total longitudinal extension GL of the shoe, measured from the tip 14 of the shoe. Thereby, the deflection element 13 which is designed as a loop joins substantially in the transition region between the sole 19 and shoe upper 2.

The second deflection element 15 is positioned in such a manner that the tensioning element 4 is guided substantially horizontally from the first deflection element 14 to rear end (directed to the heel). The longitudinal position of the second deflection element 15 is located at a marking between 50% and 60% of the longitudinal extension GL, again measured from the tip 14 of the shoe.

The tensioning element 4 is guided from the second deflection element 15 upwards in the direction of the rotary fastener 3. Below the rotary fastener 3 a third deflection element 16 is arranged which deflects the tensioning element 4 substantially by 180° and guides again downwards, namely to a fourth deflection element 17 which is located at a marking between 55% and 70% of the longitudinal extension GL of the shoe.

Finally, the tensioning element 4 is guided from the fourth deflection element 14 to a fifth deflection element 18 which is arranged with respect to its height position at a level between 33% and 66% of the total height of the shoe. With respect to the longitudinal position the fifth deflection element 18 is arranged at a location which lies in a region between 75% and 90% of the longitudinal extension GL, measured from the tip 14 of the shoe. The tensioning element 4 runs then back from the fifth deflection element 18 to the rotary fastener 3.

All deflection elements 13, 15, 16, 17 and 18 are designed in the embodiment as bands which are formed to a loop and are fixed at the shoe upper. With respect to the fifth deflection element 18 it can be seen that this runs around the heel region 20 of the shoe 1 and joins at the same respectively.

The two right end regions of the fifth deflection element 18 which can be seen in FIG. 1 start at different height positions of the heel 20, namely at the one hand relatively low near the sole 19 and at the other hand a little amount below of the upper end of the heel 20. Correspondingly, the depicted V-shaped structure results.

The closed curves 12 are designed substantially symmetrical at both sides of the shoe upper 2, namely to a centre plane which is arranged centrally in the shoe 1, which is oriented vertically and which runs in longitudinal direction of the shoe.

By the proposed design the shoe can not only be laced very easy by rotating of the tensioning roller 7 by the wearer of the shoe, also the pressure of the tensioning element 4 and 5 is distributed very equally and leads to a homogeneous fit of the shoe 1 at the foot of the wearer.

Thereby, it can be provided that the outermost layer of the shoe upper 2 covers the tensioning element 4 and 5 so that the same are not visible.

LIST OF REFERENCES

1 Shoe
2 Shoe upper
3 Rotary fastener
4 First tensioning element
5 Second tensioning element
6 Instep
7 Tensioning roller
8 End of the first tensioning element
9 End of the first tensioning element
10 End of the second tensioning element
11 End of the second tensioning element
12 Closed curve
13 First deflection element
14 Tip of shoe
15 Second deflection element
16 Third deflection element
17 Fourth deflection element

18 Fifth deflection element
19 Sole
20 Heel region
21 Handwheel
M Medial side of the shoe upper
L Lateral side of the shoe upper
a Axis of rotation of the tensioning roller
GL Longitudinal extension of the shoe

The invention claimed is:

1. A shoe, with a shoe upper, a sole, and a rotary fastener for lacing the shoe on the foot of the wearer by means of at least one tensioning element, wherein the rotary fastener is arranged on an instep of the shoe and wherein the rotary fastener has a rotatably arranged tensioning roller, wherein a first tensioning element is arranged, which runs on a lateral side of the shoe upper, wherein a second tensioning element is arranged, which runs on a medial side of the shoe upper, and wherein each tensioning element has two ends fixed to the tensioning roller and forms a closed curve on the lateral side or on the medial side of the shoe upper, wherein the each tensioning element runs from the tensioning roller to a first deflection element, which deflects the tensioning element in a bottom region of the shoe upper as well as at a location which is arranged in a region between 30% and 42% of the longitudinal extension, measured from a tip of the shoe.

2. The shoe according to claim 1, wherein the two closed curves of the two tensioning elements on the lateral side and on the medial side of the shoe upper are designed substantially symmetrically to a centre plane of the shoe, wherein the centre plane runs vertically and in longitudinal direction of the shoe.

3. The shoe according to claim 1, wherein the tensioning roller can be rotated by means of an external electric motor drive.

4. The shoe according to claim 1, wherein an axis of rotation of the tensioning roller is perpendicular to a surface of the shoe in the region of the instep.

5. The shoe according to claim 1, wherein each tensioning element runs from the first deflection element to a second deflection element, which deflects the tensioning element in the bottom region of the shoe upper as well as at a location which is arranged in a region between 50% and 60% of the longitudinal extension, measured from the tip of the shoe.

6. The shoe according to claim 5, wherein each tensioning element runs from the second deflection element to a third deflection element, wherein the third deflection element is arranged in the upper region of the shoe upper adjacent to the rotary fastener.

7. The shoe according to claim 6, wherein each tensioning element runs from the third deflection element to a fourth deflection element, which deflects the tensioning element in the bottom region of the shoe upper as well as at a location which is arranged in a region between 55% and 70% of the longitudinal extension, measured from the tip of the shoe.

8. The shoe according to claim 7, wherein each tensioning element runs from the fourth deflection element to a fifth deflection element, which deflects the tensioning element in the region between 33% and 66% of a total height of the shoe as well as at a location which is arranged in a region between 75% and 90% of the longitudinal extension, measured from the tip of the shoe, wherein the tensioning element runs from the fifth deflection element to the tensioning roller.

9. The shoe according to claim 1, wherein at least one of the deflection elements is designed as a loop which is fixed at the shoe upper and/or at the sole of the shoe.

10. The shoe according to claim 9, wherein the loop consists of a band which is stitched on the shoe upper and/or on the sole of the shoe.

11. The shoe according to claim 8, wherein the fifth deflection element encompasses a heel region of the shoe.

12. The shoe according to claim 11, wherein the fifth deflection element has a V-shaped design with two legs in a side view of the shoe, wherein in the side view of the shoe one of the two legs of the V-shaped structure terminates in the upper heel region and the other leg of the two legs of the V-shaped structure terminates in the bottom heel region.

13. The shoe according to claim 1, wherein the tensioning elements are tensioning wires.

14. The shoe according to claim 1, wherein the tensioning elements comprise polyamide or consist of this material.

* * * * *